US007966922B2

(12) United States Patent
Gaigler et al.

(10) Patent No.: US 7,966,922 B2
(45) Date of Patent: Jun. 28, 2011

(54) ELECTRO-MAGNETIC RESTRAINT

(75) Inventors: Randy L. Gaigler, Parkville, MD (US); Leszek Stanislaw Basak, Nottingham, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 1218 days.

(21) Appl. No.: 11/753,426

(22) Filed: May 24, 2007

(65) Prior Publication Data

US 2011/0011252 A1 Jan. 20, 2011

(51) Int. Cl.

| | |
|---|---|
| ***F41F 1/00*** | (2006.01) |
| ***F41F 3/04*** | (2006.01) |
| ***F41A 19/00*** | (2006.01) |
| ***F41B 6/00*** | (2006.01) |

(52) U.S. Cl. ..... 89/8; 89/1.806; 89/135; 42/84; 124/3

(58) Field of Classification Search ..... 89/1.806, 89/8, 28.05, 28.1, 135; 42/84; 124/3, 32
See application file for complete search history.

(56) References Cited

U.S. PATENT DOCUMENTS

| | | | | |
|---|---|---|---|---|
| 3,779,128 | A * | 12/1973 | Pelaez | 89/1.3 |
| 4,191,087 | A * | 3/1980 | Campbell et al. | 89/1.806 |
| 4,416,183 | A * | 11/1983 | Adams et al. | 89/1.807 |
| 6,650,212 | B1 | 11/2003 | Weems | |
| 7,506,570 | B1 * | 3/2009 | Koski | 89/1.806 |
| 2006/0011055 | A1 * | 1/2006 | Root | 89/1.819 |
| 2009/0007764 | A1 * | 1/2009 | Gaigler et al. | 89/1.812 |
| 2010/0089227 | A1 * | 4/2010 | Root, Jr. | 89/1.813 |

* cited by examiner

*Primary Examiner* — Michelle (Shelley) Clement
(74) *Attorney, Agent, or Firm* — DeMont & Breyer, LLC

(57) ABSTRACT

A restraint for immobilizing a projectile with respect to its launch system is disclosed. When electromagnetic force is applied to the restraint, the restraint releases the projectile, thereby enabling its launch.

21 Claims, 5 Drawing Sheets

ELECTRO-MAGNETIC RESTRAINT

CROSS REFERENCE TO RELATED APPLICATIONS

The underlying concepts, but not necessarily the language, of the following cases are incorporated by reference:

(1) U.S. patent application Ser. No. 10/899,234, filed 26 Jul. 2004; and (2) U.S. patent application Ser. No. 11/278,988, filed 7 Apr. 2006.

If there are any contradictions or inconsistencies in language between this application and one or more of the cases that have been incorporated by reference that might affect the interpretation of the claims in this case, the claims in this case should be interpreted to be consistent with the language in this case.

FIELD OF THE INVENTION

The present invention relates to missilery in general, and, more particularly, to missile launchers.

BACKGROUND OF THE INVENTION

A projectile, such as a missile, a mortar round, and the like, is often stored, shipped, and carried to its point of deployment in a canister. Among other things, the canister protects the projectile from harsh environmental conditions. A typical canister comprises a launch tube that guides the projectile as it is launched, much like the launch tube of a gun. At deployment, the projectile is propelled from its canister using either its self-propulsion engine or by external means such as an electromagnetic launcher, compressed gas, mechanical catapult, and the like.

Typically, each projectile is secured within its canister by a mechanical release restraint in order to avoid damage during transport. In order to launch the projectile, the restraint is actuated to release it from its canister. This enables the projectile to be propelled from the canister. Restraints known in the prior-art include explosive bolts, marmon clamps, bullet jackets, and shape charges.

These restraints have several drawbacks, however. First, they require proactive actuation in the form of electro-mechanical, motor driven, or explosives. As a result, additional infrastructure and/or control signals are required to make them release their projectile. This increases the complexity and cost of the launch systems in which they are employed.

Second, many canisters are designed with reload capability so that they can be reused to launch additional projectiles. Since many of these restraints leave residue or other material behind after their actuation during the launch of their projectile. This residual material must be removed prior to a subsequent launch. For systems capable of multiple launches, therefore, the time between consecutive launches is increased. This decreases the overall firepower of the launch system. In addition, additional labor and/or personnel are required to remove the residual material.

Finally, the need to proactively actuate these prior-art restraints leads to a reliability issue. If an actuation signal is not sent to the restraint, or the actuation signal is not received by the restraint, a catastrophic accident, such as the detonation of a projectile within its canister, can ensue.

Therefore, the need exists for a restraint that avoids or mitigates some or all of these problems.

SUMMARY OF THE INVENTION

The present invention provides a mechanical release restraint for securing a projectile within a launch system without some of the costs and disadvantages associated with restraints known in the prior art.

An embodiment of the present invention comprises an electrically-conductive collar which acts as a retaining ring for a projectile. In the absence of electromagnetic force, the retaining ring secures the projectile to its launch tube, thereby immobilizing the projectile with respect to the launcher. In some embodiments, the retaining ring is installed on the projectile itself. In some embodiments, the retaining ring is installed on another structure, such as an armature, within the launcher. In some embodiments, the retaining ring is installed as part of the launcher itself.

When electromagnetic force is applied to the restraint, the restraint disengages from at least one of the projectile and the launcher, thereby enabling the projectile to move with respect to the launch tube. The present invention is particularly well-suited for electromagnetic launch systems. In some embodiments wherein the restraint is used with an electromagnetic launcher, the restraint is passively actuated by the drive coils of the launcher as they propel a projectile from the launcher.

In some embodiments, a dedicated coil is employed just for providing the electromagnetic force used to actuate the restraint.

In some embodiments, the restraint is a part of a projectile itself. As a result, no residual matter is left in the launch system after the projectile is launched.

In some embodiments, the restraint immobilizes an armature that is used to propel a projectile from a launch tube. In some embodiments, the armature propels a projectile from its launch tube with only the use of electromagnetic force.

An embodiment of the present invention comprises: a propulsion system for propelling a missile; a guide for guiding the missile; a first coil for carrying a flow of electric current, wherein the first coil is substantially immovable with respect to the guide; and a restraint for substantially immobilizing the missile with respect to the guide, wherein the flow of electric current induces the restraint to enable motion of the missile with respect to the guide.

DETAILED DESCRIPTION

The following terms are defined for use in this Specification, including the appended claims:

Physically-connected means in direct, physical contact and affixed (e.g., a mirror that is mounted on a linear-motor).

Physically-coupled means in direct, physical contact, although not necessarily physically-connected (e.g., a coffee cup resting on a desktop).

Projectile means an object that is fired, thrown, or otherwise propelled. Examples of projectiles include, without limitation, artillery shells, mortar rounds, self-propelled missiles, guided missiles, and countermeasure devices, such as flares, chaff, acoustic emitters, IR emitters, and the like.

Figure 1:
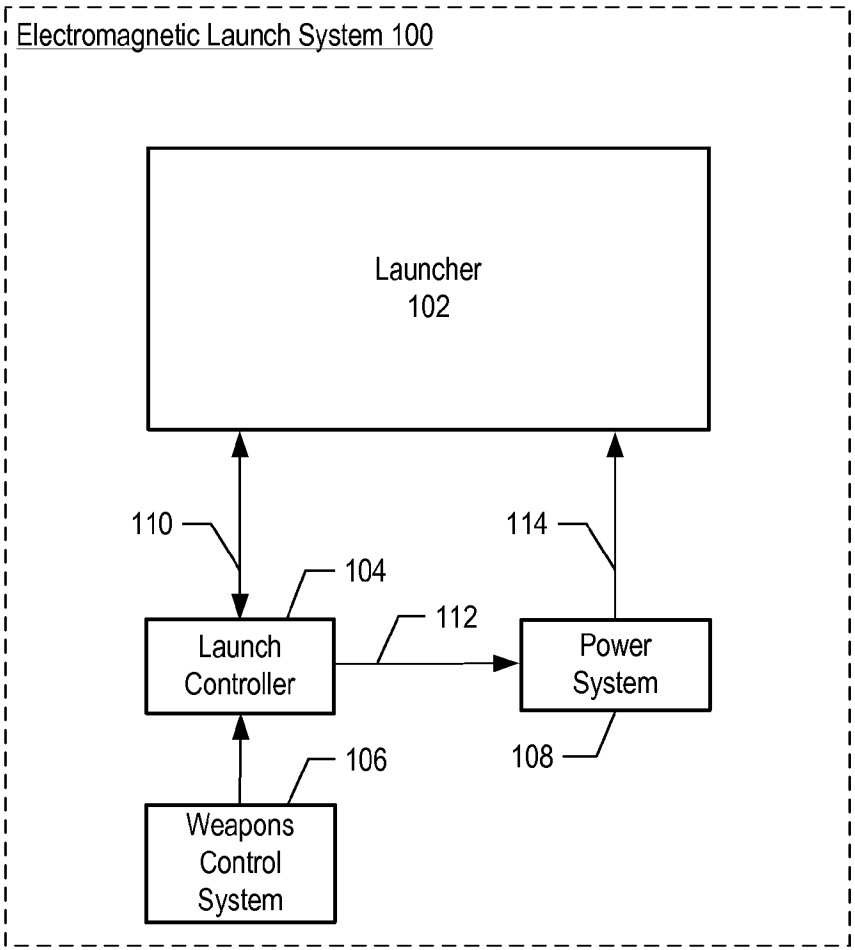
FIG. 1 depicts a schematic diagram of a launch system in accordance with an illustrative embodiment of the present invention.

FIG. 1 depicts a schematic diagram of a launch system in accordance with an illustrative embodiment of the present invention. Launch system 100 comprises launcher 102, launch controller 104, weapons control system 106, power system 108, control cable 110, signal line 112, and current cable 114.

Launcher 102 is a system that has the capability to house and expel one or more projectiles upon command. In the illustrative embodiment launcher 102 expels a guided missile comprising a chemical-propulsion engine. Launcher 102 expels the guided missile from its associated launch cell using an electromagnetic catapult, and without the aid of the missile's chemical-propulsion engine. It will be clear to those of ordinary skill in the art, however, after reading this specification, how to make and use alternative embodiments of the present invention wherein launcher 102 expels a projectile by means of non-electromagnetic propulsion, such as chemical propellants, compressed air, pneumatics, mechanical force, and the like. In some embodiments, launcher 102 employs the self-propulsion means of the projectile, such as a chemical-propellant engine, to expel, or help expel, each missile. In some embodiments, launcher 102 is capable of propelling munitions that have no self-propulsion, such as artillery shells, mortar rounds, countermeasure devices, and the like. In some embodiments, launcher 102 comprises apparatus for controlling the azimuth and elevation at which a projectile is launched.

Although in the illustrative embodiment electromagnetic launch system 100 comprises a launcher having a single launch cell, it will be clear to those skilled in the art, after reading this specification, how to make and use alternative embodiments of the present invention wherein launcher 102 comprises more than one launch cell.

Launch controller 104 provides the targeting and flight information to a missile prior to launch and the directive to launch to power system 108.

Weapons control system 106 provides targeting and flight information and firing authority to launch controller 104 prior to and during a launch sequence. It will be clear to those skilled in the art, after reading this disclosure, how to make and use weapons control system 106.

Power system 108 comprises circuitry that conditions and manages the storage and delivery of power to, and the recovery of power from, launcher 102 in response to signals from launch controller 104. Power system 108 controls power generation, scavenging, storage, and delivery prior to, during, and after each launch. Power system 108 is described in detail in U.S. patent application Ser. No. 10/899,234, filed on 26 Jul. 2004, which is incorporated by reference herein.

Control cable 110 carries the targeting information from launch controller 104 to the missile.

Signal line 112 connects launch controller 104 to power system 108 and carries the commands that direct power system 108 to initiate and control the launch of a missile.

Current cable 114 carries power from power system 108 to launcher 102. In some embodiments of the present invention that comprise multiple launch cells, current cable 114 is capable of carrying power to each launch cell independently from the other launch cells.

Figure 2:
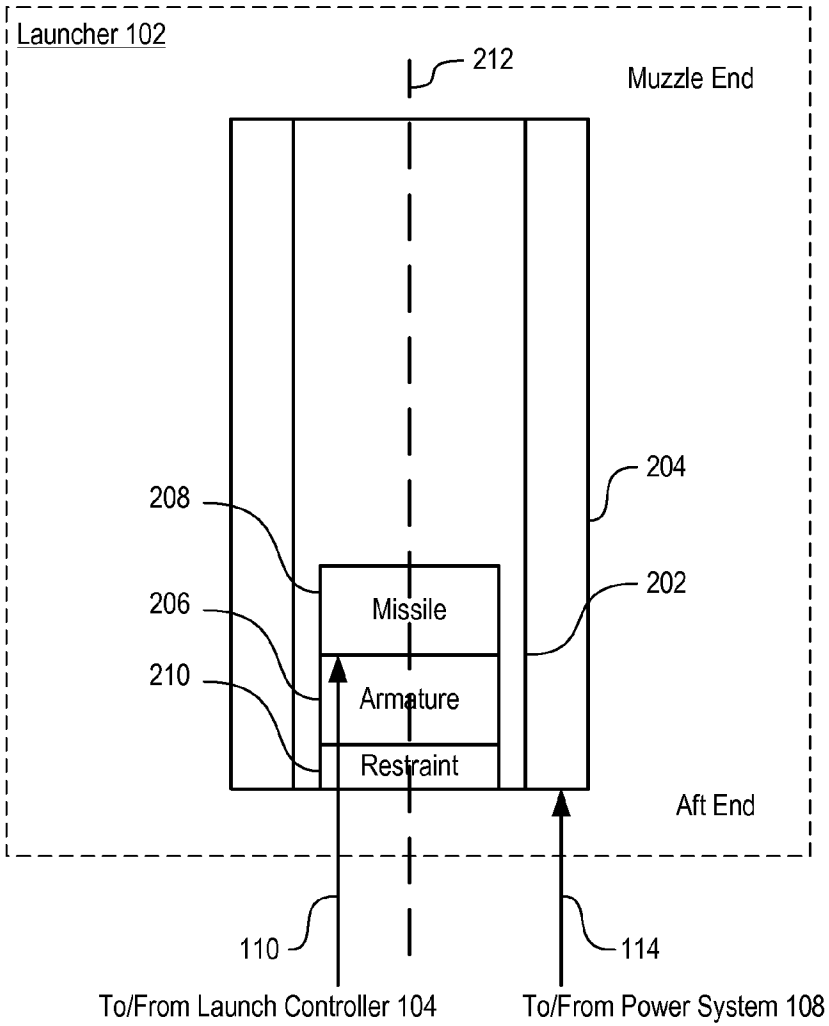
FIG. 2 depicts a schematic diagram of details of a launcher in accordance with the illustrative embodiment of the present invention.

FIG. 2 depicts a schematic diagram of details of a launcher in accordance with the illustrative embodiment of the present invention. Launcher 102 comprises launch tube 202, electromagnetic catapult 204, armature 206, missile 208, and restraint 210.

Launch tube 202 is a cylindrical tube that has sufficient interior diameter to accommodate missile 208, armature 206, and restraint 210, and sufficient strength to withstand the forces exerted on launch tube 202 during a missile launch. Launch tube 202 is formed of material that is non-magnetic so that it does not perturb mutual induction between electromagnetic catapult 204 and either of armature 206 or restraint 210. Launch tube 202 guides armature 206 as it propels missile 208 along launch axis 212 during a launch.

Electromagnetic catapult 204 is a powerful electromagnet comprising a series of electrically-conductive coils. Electromagnetic catapult 204 is powered and controlled by power system 108 via cable 114.

Armature 206 comprises a rigid platform and an electrically-conductive coil. Armature 206, electromagnetic catapult 204, and power system 108 together compose an electromagnetic propulsion system. When electric current flows in electromagnetic catapult 204, a mutual inductance between electromagnetic catapult 204 and armature 206 results in a force directed upon armature 206. This force causes armature 206 to accelerate and propel missile 208 out of launch tube 202. Armature 206 accelerates missile 208 to a velocity sufficient for missile 208 to attain aerodynamic flight after exiting launch tube 202. In some embodiments, armature 206 comprises a conductive material. In some embodiments, armature 206 comprises a ferromagnetic material. In some embodiments, missile 208 acts as its own armature and no separate armature is necessary.

Restraint 210 comprises a hoop of conductive material suitable for establishing a mutual inductance with electromagnetic catapult 204. Restraint 210 secures armature 206 and/or missile 208 in launch tube 202 prior to launch. When an electric current flows in electromagnetic catapult 204, a mutual inductance between electromagnetic catapult 204 and restraint 210 causes restraint 210 to release armature 206. In the illustrative embodiment, restraint 210 releases armature 206 when electromagnetic catapult 204 is energized in order to propel armature 206. In other words, restraint 210 actuates passively when electromagnetic catapult 204 is energized to propel armature 206. In some embodiments, restraint 210 is designed to actuate only if electromagnetic catapult 204 is energized sufficiently to propel missile 208 with enough force to clear launch tube 202.

Figure 3A:
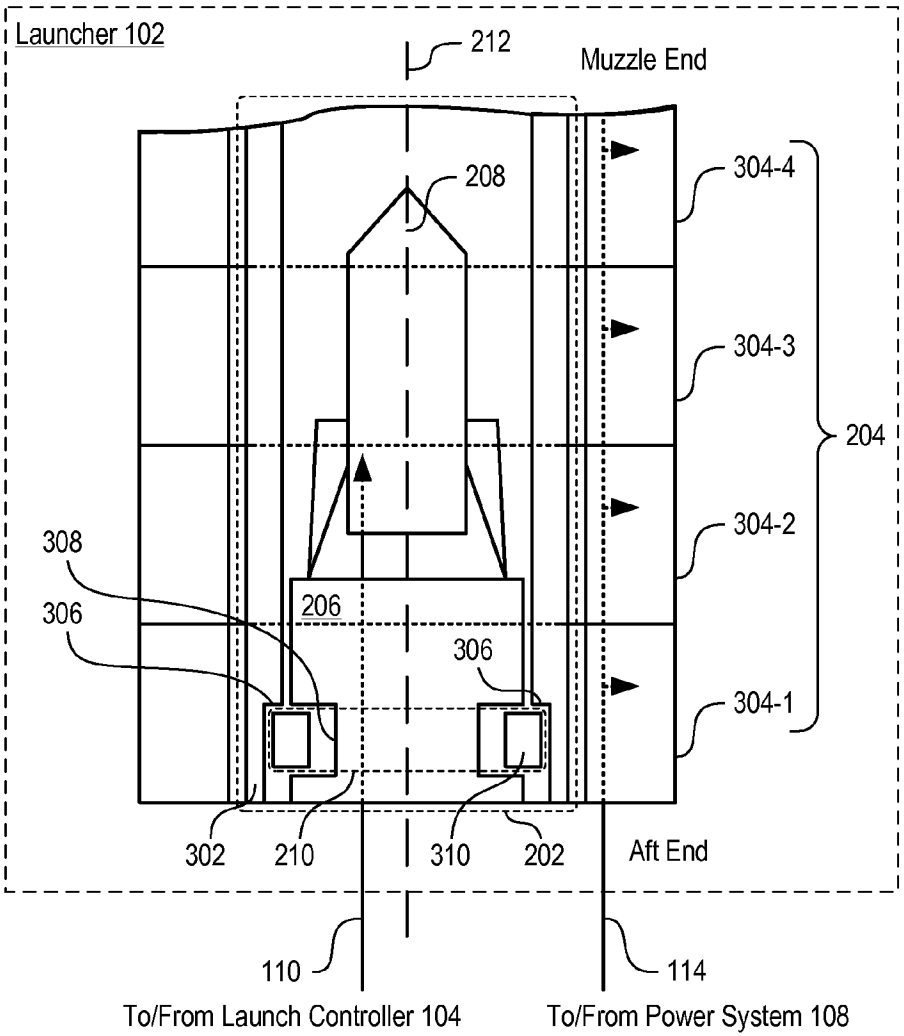
FIG. 3A depicts a cross-sectional view showing details of a portion of a launcher, prior to a launch, in accordance with the illustrative embodiment of the present invention.
Figure 3B:
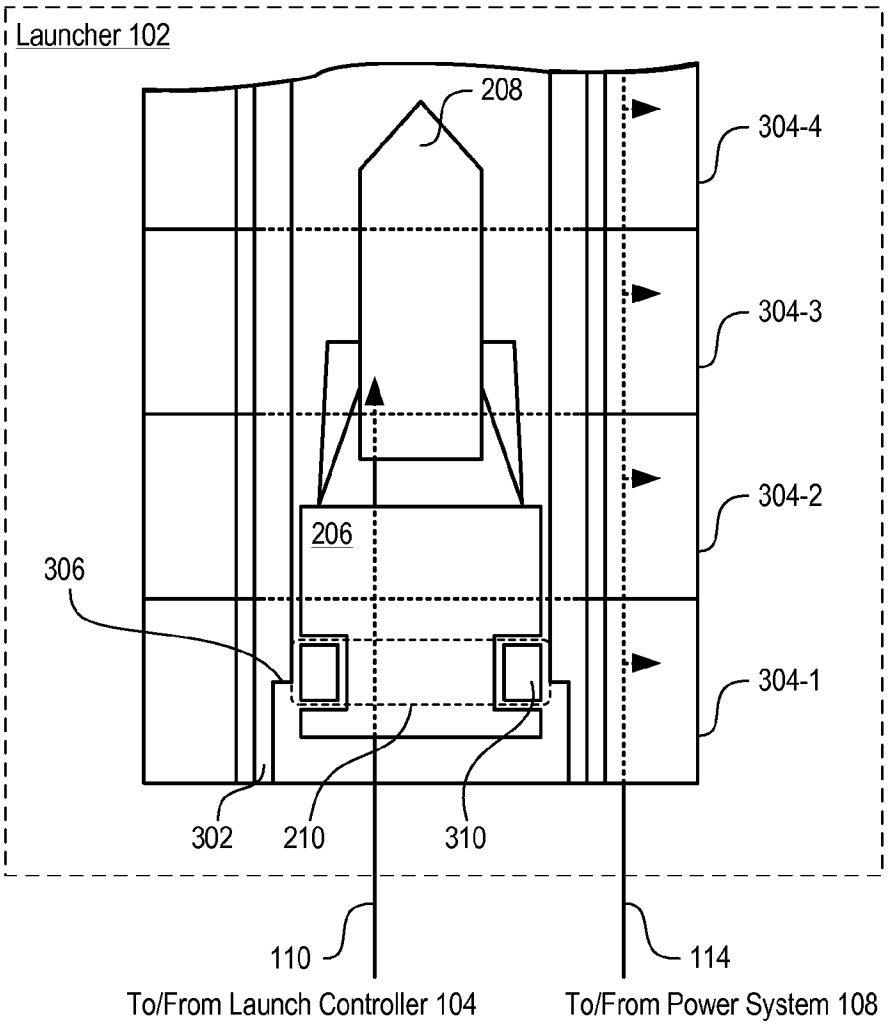
FIG. 3B depicts a cross-sectional view showing details of a portion of a launcher, after commencement of a launch, in accordance with the illustrative embodiment of the present invention.

FIGS. 3A and 3B depict a cross-sectional view showing details of a portion of a launcher, prior to and after commencement of a launch, respectively, in accordance with the illustrative embodiment of the present invention.

Launcher 102 comprises launch tube 202, electromagnetic catapult 204, armature 206, missile 208, and restraint 210.

Launch tube 202 comprises launch tube wall 302. Launch tube wall 302 guides armature 206 and missile 208 as they travel along launch axis 212 during a launch. In some embodiments, launch tube 202 also forms a part of a canister that provides a substantially air-tight environment for missile 208. Launch tube wall 302 is provided shoulder 306, which provides a feature against which restraint 210 can secure armature 206. In some embodiments, shoulder 306 is formed by boring the aft end of launch tube 202 to a larger diameter than the muzzle portion of launch tube 202. In some embodiments, shoulder 306 is formed by one or more detents in launch tube wall 302.

Electromagnetic catapult 204 comprises a plurality of individually-addressable electrically-conductive coils, referred to collectively as coils 304. FIGS. 3A and 3B depict only four (4) such coils, 304-1 through 304-4.

Armature 206 comprises seat 308, which provides structure for locating restraint 210.

Restraint 210 comprises hoop 310, which is made of an electrically-conductive material. Materials suitable for use in hoop 310 include, without limitation, steel, aluminum, copper, and the like. In the absence of an electric current in coil 304-1, hoop 310 has an outer diameter larger than the inner diameter of shoulder 306. Hoop 310 has thickness sufficient for providing enough strength in the longitudinal direction (i.e., parallel to launch axis 212) to substantially immobilize armature 206 with respect to launch tube 202 and launch axis 212.

During a launch, power system 106 energizes coil 304-1 with electric current via current cable 114. The flow of electric current in coil 304-1 causes a mutual inductance between coil 304-1 and armature 206. The mutual inductance between coil 304-1 and armature 308 results in a force that acts to propel armature 206 toward the muzzle end of launch tube 202.

At the same time, the flow of electric current in coil 304-1 causes a mutual inductance between coil 304-1 and hoop 310. The mutual inductance between coil 304-1 and hoop 310 results in a force that compresses hoop 310 into a shape having a smaller diameter than the muzzle end of launch tube 202. In other words, hoop 310 is compressed sufficiently to cause it to disengage from shoulder 306. As a result, armature 206 is no longer immobilized with respect to launch axis 212. Thus, armature 206 is enabled to accelerate toward the muzzle end of launch tube 202 and thereby propel missile 208, as depicted in FIG. 3B.

As armature 206 moves, power system 106 sequences the flow of electric current from stackable coil 304-1 to stackable coil 304-2 and then to stackable coil 304-3. The sequencing of the flow of electric current serves to maintain the acceleration of armature 206 and missile 208 so as to impart sufficient velocity to the missile for it to achieve aerodynamic flight. In some embodiments, as the flow of electric current sequences from coil to coil, the force that compresses hoop 310 is maintained as armature 206 travels along launch axis 212. In some embodiments, restraint 210 comprises a latching mechanism that engages when hoop 310 is compressed. This latch mechanism keeps hoop 310 at its smaller diameter throughout the travel of armature 206. As a result, hoop 310 does not expand and thereby avoids friction with launch tube wall 302 during a launch. In some embodiments, hoop 310 is designed to irreversibly deform (e.g., crumple inward, etc.) upon being subjected to desired amount of radial force, thereby avoiding friction between restraint 206 and launch tube 202 during launch.

Although the illustrative embodiment comprises a coil that both propels armature 206 and actuates restraint 210, it will be clear to those of ordinary skill in the art, after reading this specification, how to make and use alternative embodiments of the present invention wherein restraint 210 is actuated by a coil that does not also propel an armature and/or projectile. Embodiments of the present invention, therefore, may be used with launchers that propel a projectile by non-electromagnetically-generated force.

In some embodiments, restraint 210 comprises magnetostrictive material. In these embodiments, restraint 210 enables the motion of armature 206 along launch axis 212 in response to the magnetic field that results from the flow of electric current in coils 304.

In some embodiments, restraint 210 comprises a magnetic material. In some embodiments, hoop 310 expands to release armature 206. In these embodiments, restraint 210 resides in a seat located not on armature 206 (e.g., in launch tube wall 302).

Figure 4B:
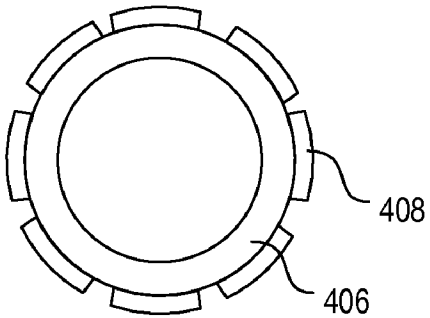
FIG. 4B depicts a top view of a restraint, in accordance with an alternative embodiment of the present invention.
Figure 4D:
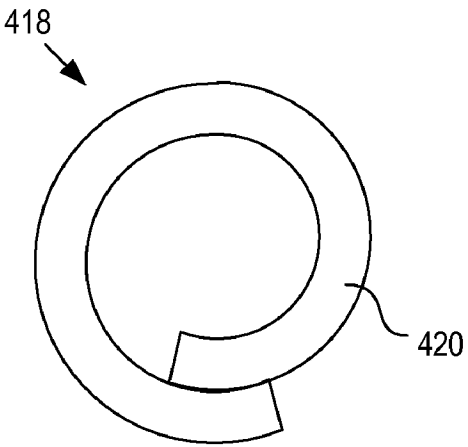
FIG. 4D depicts a top view of a restraint, in accordance with an alternative embodiment of the present invention.
Figure 4A:
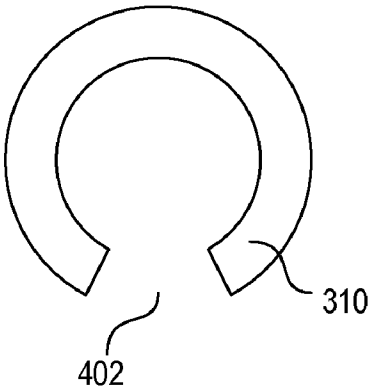
FIG. 4A depicts a top view of a restraint in accordance with the illustrative embodiment of the present invention.

FIG. 4A depicts a top view of a restraint in accordance with the illustrative embodiment of the present invention. Restraint 210 comprises hoop 310 and gap 402.

Hoop 310 is a hoop of electrically-conductive material with a height suitable to ensure sufficient strength in the longitudinal direction (i.e., parallel to launch axis 212) to substantially immobilize armature 206 with respect to launch axis 212. Hoop 310 is designed so that its outer diameter, when compressed, is no larger than the inner diameter of launch tube 202, and preferably no larger than the outer dimensions of armature 206. When hoop 310 is uncompressed, however, its outer diameter is large enough to engage shoulder 306.

Gap 402 enables hoop 310 to compress or expand in response to a radially-applied force and thereby reduce or enlarge its diameter as necessary.

It will be clear to those of ordinary skill in the art, after reading this specification, how to make and use hoop 310.

FIG. 4B depicts a top view of a restraint, in accordance with an alternative embodiment of the present invention. Restraint 404 comprises hoop 406 and projections 408.

Hoop 406 is a hoop of electrically-conductive material with a height sufficient to provide suitable bonding area for projections 408. Hoop 406 compresses or expands in response to a radially-applied force.

Projections 408 are rigid blocks of structural material having sufficient strength to engage shoulder 306 and immobilize armature 206 with respect to launch axis 212.

Hoop 406 is designed so that, when compressed, projections 408 are within the inner diameter of launch tube 202, and preferably within the outer dimensions of armature 206. When hoop 406 is uncompressed, however, projections 408 engage shoulder 306. In some embodiments, projections 408 are not included and hoop 406 engages shoulder 306 to immobilize armature 206 with respect to launch axis 212.

Figure 4C:
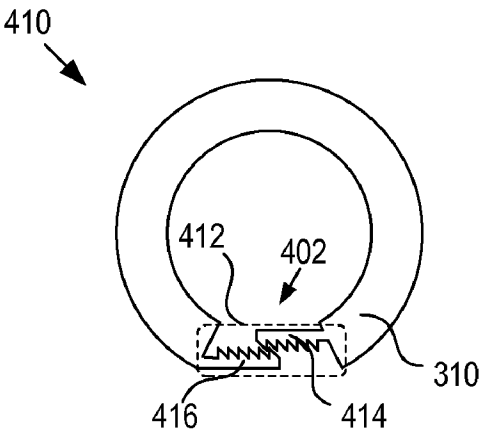
FIG. 4C depicts a top view of a restraint, in accordance with an alternative embodiment of the present invention.

FIG. 4C depicts a top view of a restraint, in accordance with an alternative embodiment of the present invention. Restraint 410 comprises hoop 310 and latch 412.

Latch 412 is a substantially irreversible catch located within gap 402. Latch 412 comprises jaws 414 and 416. When hoop 310 is compressed in response to the flow of electric current in coil 304-1, jaws 414 and 416 engage to keep hoop 310 from expanding once the flow of electric current stops. Hoop 310, therefore, is kept in its compressed state even after the removal of the force that acts upon it. Once latch 412 is engaged, it must be manually disengaged. It should be noted that latch 412, as depicted, is only one of many latches suitable for use in restraint 410. In some embodiments, springs are used to ensure that latch 412 remains engaged throughout the actuation of restraint 410. In some embodiments, the force that ensures latch 412 remains engaged is provided by hoop 310. It will be clear to those skilled in the art, after reading this specification, how to specify, make, and use latch 412.

FIG. 4D depicts a top view of a restraint, in accordance with an alternative embodiment of the present invention. Restraint 418 comprises spiral 420.

Spiral 420 is a spiral of electrically-conductive material with a thickness suitable for engaging shoulder 306 to immobilize armature 206 with respect to launch axis 212. Spiral 420 compresses or expands in response to a radially-applied force, thereby disengaging from shoulder 306. In some embodiments, spiral 420 maintains a continuously electrically-conductive circular circuit during expansion or contraction to facilitate inductive coupling during a launch event.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. An apparatus comprising:

a propulsion system for propelling a missile;

a guide for guiding the missile;

a first coil for carrying a flow of electric current, wherein the first coil is substantially immovable with respect to the guide; and a restraint for substantially immobilizing the missile with respect to the guide, wherein the flow of electric current induces the restraint to enable motion of the missile with respect to the guide;

wherein the restraint comprises a band having a first diameter in the absence of the flow of electric current and a second diameter in response to the flow of electric current, and further wherein the band comprises an electrical conductor.

2. The apparatus of claim 1 wherein the propulsion system comprises the first coil, and wherein the flow of electric current induces the missile to move with respect to the guide.

3. The apparatus of claim 1 further comprising an armature for throwing the missile, wherein the propulsion system propels the armature to move with respect to the guide and to throw the missile.

4. The apparatus of claim 3 wherein the flow of electric current induces the armature to move with respect to the guide.

5. The apparatus of claim 1 wherein the flow of electric current induces the band to compress such that the second diameter is smaller than the first diameter.

6. The apparatus of claim 1 wherein the flow of electric current induces the band to enlarge such that the second diameter that is larger than the first diameter.

7. The apparatus of claim 1 wherein the band comprises a magnetostrictive material.

8. The apparatus of claim 1 further comprising the missile, wherein the missile comprises a munition.

9. The apparatus of claim 8 wherein the munition comprises an explosive warhead and a chemical-propulsion engine.

10. An apparatus comprising:

a guide for guiding a missile along a line, wherein the guide comprises a tube haying a longitudinal axis, wherein the longitudinal axis and the line are substantially coincident;

a propulsion system for propelling the missile, wherein the propulsion system propels the missile with an electromagnetic force; and a restraint for substantially immobilizing the missile with respect to the line, wherein the electromagnetic force induces the restraint to enable motion of the missile along the line;

wherein the restraint immobilizes the missile by engaging the tube in the absence of the electromagnetic force, and further wherein the electromagnetic force induces the restraint to disengage from the tube.

11. The apparatus of claim 10 further comprising an armature, wherein the propulsion system propels the armature to propel the missile.

12. The apparatus of claim 10 further comprising the missile, wherein the missile comprises a munition.

13. The apparatus of claim 12 wherein the munition comprises a missile having an explosive warhead and a chemical-propellant engine.

14. The apparatus of claim 10 wherein the tube comprises a shoulder, and wherein the restraint comprises a projection for engaging the shoulder, and further wherein the electromagnetic force induces the restraint to disengage the projection from the shoulder.

15. An apparatus comprising:

a guide for guiding a missile along a line;

a first coil for carrying a flow of electric current; and a restraint for substantially immobilizing the missile with respect to the line;

wherein a flow of electric current in the first coil induces the restraint to enable the motion of the missile along the line;

wherein the restraint engages the guide and the missile in the absence of the flow of electric current, and further wherein the flow of electric current induces the restraint to disengage from at least one of the guide and the missile.

16. The apparatus of claim 15 wherein the flow of electric current induces motion of the missile along the line.

17. The apparatus of claim 15 further comprising an armature for propelling the missile along the line, wherein the flow of electric current induces the armature to propel the missile.

18. The apparatus of claim 17 wherein the restraint engages the guide and the armature in the absence of the flow of electric current, and further wherein the flow of electric current induces the restraint to disengage from at least one of the guide and the armature.

19. The apparatus of claim 15 wherein the restraint comprises a deformable band having a first diameter in the absence of the flow of electric current, and wherein the flow of electric current induces the deformable band to compress to a second diameter, and wherein the restraint immobilizes the missile with respect to the line when the deformable band has the first diameter, and further wherein the restraint enables motion of the missile with respect to the line when the deformable band has the second diameter.

20. The apparatus of claim 15 wherein the restraint comprises a deformable band having a first diameter in the absence of the flow of electric current, and wherein the flow of electric current induces the deformable band to expand to a second diameter, and wherein the restraint immobilizes the missile with respect to the line when the deformable band has the first diameter, and further wherein the restraint enables motion of the missile with respect to the line when the deformable band has the second diameter.

21. The apparatus of claim 15 wherein the restraint comprises a deformable band having a first shape, and wherein the flow of electric current induces the deformable band to deform from the first shape, and wherein the restraint immobilizes the missile with respect to the line when the deformable band has the first shape, and further wherein the restraint enables motion of the missile with respect to the line when the deformable band is deformed from the first shape.

* * * * *